US007347279B2

(12) United States Patent
Li et al.

(10) Patent No.: US 7,347,279 B2
(45) Date of Patent: Mar. 25, 2008

(54) CHARGE HOLDER APPARATUS

(75) Inventors: Haoming Li, Missouri City, TX (US); Mark C. Duhon, Sugar Land, TX (US); Wanchai Ratanasirigulcha, Sugar Land, TX (US); Steven W. Henderson, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 407 days.

(21) Appl. No.: 10/708,075

(22) Filed: Feb. 6, 2004

(65) Prior Publication Data

US 2005/0173118 A1 Aug. 11, 2005

(51) Int. Cl.
*E21B 43/116* (2006.01)

(52) U.S. Cl. ..... 175/4.6; 166/55; 166/297

(58) Field of Classification Search ..... 166/297, 166/55, 55.1; 175/4.6; 102/306, 307, 312, 102/313

See application file for complete search history.

(56) References Cited

U.S. PATENT DOCUMENTS 2,926,603 A * 3/1960 Lindsay, Jr. ..... 175/4.6
4,915,029 A 4/1990 Appledorn et al.
4,960,171 A * 10/1990 Parrott et al. ..... 166/55
5,648,635 A 7/1997 Lussier et al.
2002/0189482 A1* 12/2002 Kneisl et al. ..... 102/306

FOREIGN PATENT DOCUMENTS

GB 2308177 A 6/1997

* cited by examiner

*Primary Examiner*—Giovanna C Wright
(74) *Attorney, Agent, or Firm*—Van Someren, PC; Kevin B. McGoff; Bryan P. Galloway

(57) ABSTRACT

An adapter is provided for holding and mounting a shaped charge having a non-standard size into a standard loading tube of a hollow carrier gun. The adapter may include a housing assembly having an interior bore to hold a relatively small shaped charge and an exterior surface sized for mounting in a standard loading tube via a standard jacket. Alternatively, the adapter may include an improved jacket having interior ribs for supporting a relatively small shaped charge and an exterior surface for mounting the shaped charge in a standard loading tube of a relatively large gun.

15 Claims, 5 Drawing Sheets

CHARGE HOLDER APPARATUS

BACKGROUND OF INVENTION

The present invention relates generally to perforating tools used in downhole applications, and more particularly to a holding device for supporting charges in a perforating gun for use in a wellbore.

After a well has been drilled and casing has been cemented in the well, one or more sections of the casing, which are adjacent to formation zones, may be perforated to allow fluid from the formation zones to flow into the well for production to the surface or to allow injection fluids to be applied into the formation zones. A perforating gun string may be lowered into the well to a desired depth and the guns fired to create openings in the casing and to extend perforations into the surrounding formation. Production fluids in the perforated formation can then flow through the perforations and the casing openings into the wellbore.

Typically, perforating guns (which include gun carriers and shaped charges mounted on or in the gun carriers) are lowered through tubing or other pipes to the desired well interval. Shaped charges carried in a perforating gun are often phased to fire in multiple directions around the circumference of the wellbore. When fired, shaped charges create perforating jets that form holes in surrounding casing as well as extend perforations into the surrounding formation.

Various types of perforating guns exist. One type of perforating gun includes capsule shaped charges that are mounted on a strip in various patterns. The capsule shaped charges are protected from the harsh wellbore environment by individual containers or capsules. Another type of perforating gun includes non-capsule shaped charges, which are loaded into a sealed carrier for protection. Such perforating guns are sometimes also referred to as hollow carrier guns. The non-capsule shaped charges of such hollow carrier guns may be mounted in a loading tube that is contained inside the carrier, with each shaped charge connected to a detonating cord. When activated, a detonation wave is initiated in the detonating cord to fire the shaped charges. In a hollow-carrier gun, charges shoot through the carrier into the surrounding casing formation.

The difficulty with conventional hollow carrier guns is that conventional loading tubes are designed to receive only one particular size of shaped charge. Accordingly, if a perforation plan calls for using shaped charges of non-standard sizes (e.g., small shaped charges in a large gun), then a standard or universal loading tube cannot be used and a specialized loading tube must be fabricated.

There exists, therefore, a need for an adapter to facilitate using shaped charges of various sizes in a standard or universal loading tube. The present invention is directed at providing such an adapter.

SUMMARY OF INVENTION

In general, according to one embodiment, the present invention provides an adapter for mounting a shaped charge having any selected size into a standard or universal loading tube.

For example, an adapter in accordance with one embodiment of the present invention may include a charge holder having an interior bore shaped to receive a small shaped charge and an exterior housing shaped to fit the openings in a universal loading tube, which is generally designed to receive larger charges.

In another example, an adapter may include a charge jacket having a set of support ribs formed on the interior of the jacket to hold a small shaped charge and a latching mechanism for engaging the openings in a universal loading tube, which is set in a larger gun and is thus generally designed to receive larger charges.

Other or alternative features will be apparent from the following description, from the drawings, and from the claims.

BRIEF DESCRIPTION OF DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element" and the term "set" is used to mean "one element" or "more than one element". As used herein, the terms "up" and "down", "upper" and "lower", "upwardly" and downwardly", "upstream" and "downstream" "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
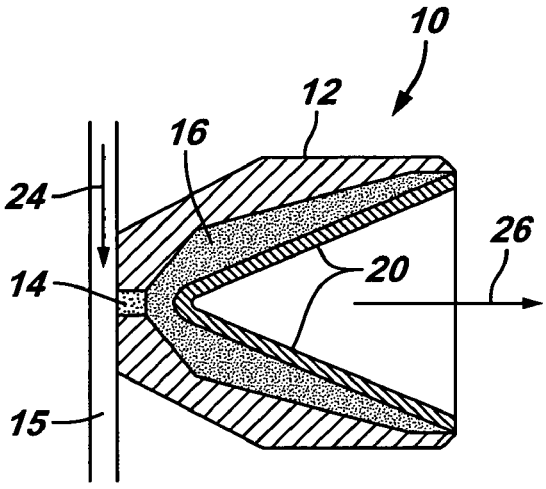
FIG. 1 (Prior Art)
FIG. 1 is a cross-sectional view of a conventional shaped charge.

Referring to FIG. 1, a conventional shaped charge 10 includes an outer case 12 that acts as a containment vessel designed to hold the detonation force of the detonating explosion long enough for a perforating jet to form. Common materials for the outer case 12 include steel or some other metal. The main explosive charge 16 is contained inside the outer case 12 and is sandwiched between the inner wall of the outer case 12 and the outer surface of a liner 20. A primer column 14 is a sensitive area that provides the detonating link between the main explosive charge 16 and a detonating cord 15, which is attached to the rear of the shaped charge 10.

To detonate the shaped charge 10, a detonation wave traveling through the detonating cord 15 initiates the primer column 14 when the detonation wave passes by, which in turn initiates detonation of the main explosive charge 16 to create a detonation wave that sweeps through the shaped charge 10. The liner 20 collapses under the detonation force of the main explosive charge 16. Material from the collapsed liner 20 forms a perforating jet that shoots through the front of the shaped charge 10, as indicated by the arrow 26.

Figure 2A:
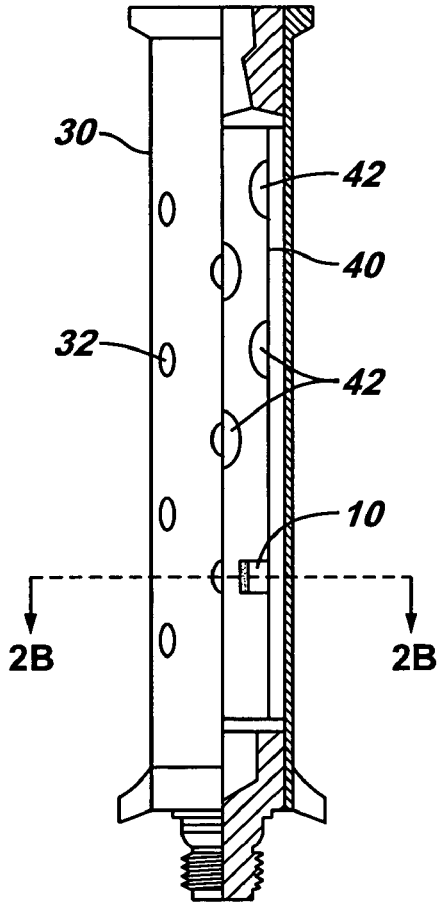
FIG. 2A (Prior Art)
FIG. 2A is a profile view of a conventional perforating gun illustrating the assembled shaped charge, loading tube, and hollow carrier.
Figure 2B:
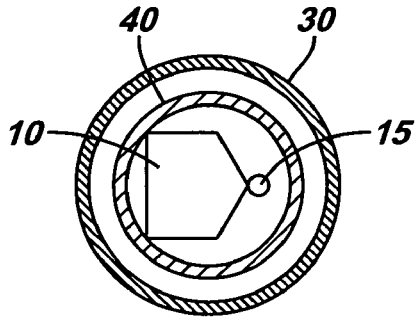
FIG. 2B (Prior Art)
FIG. 2B is a cross-sectional view of the conventional perforating gun depicted in FIG. 2A illustrating the shaped charge, loading tube, and hollow carrier.

Referring to FIGS. 2A and 2B, a plurality of shaped charges 10 may be conveyed downhole via a hollow carrier gun 30. The shaped charges 10 may be non-capsule charges since the shaped charges are protected from the environment by the hollow carrier 30, which is typically sealed. The hollow carrier 30 may also include a plurality of recesses 32 formed in the outer wall. The recesses 32 are typically localized areas where the wall thickness of the carrier 30 is reduced to facilitate penetration by the shaped charges 10. Within the hollow carrier 30, a loading tube 40 is positioned. The loading tube 40 includes a plurality of openings 42 proximal, for receiving and mounting the shaped charges 10. The openings 42 of the loading tube 40 are typically aligned with the recesses 32 of the hollow carrier 30.

Figure 3:
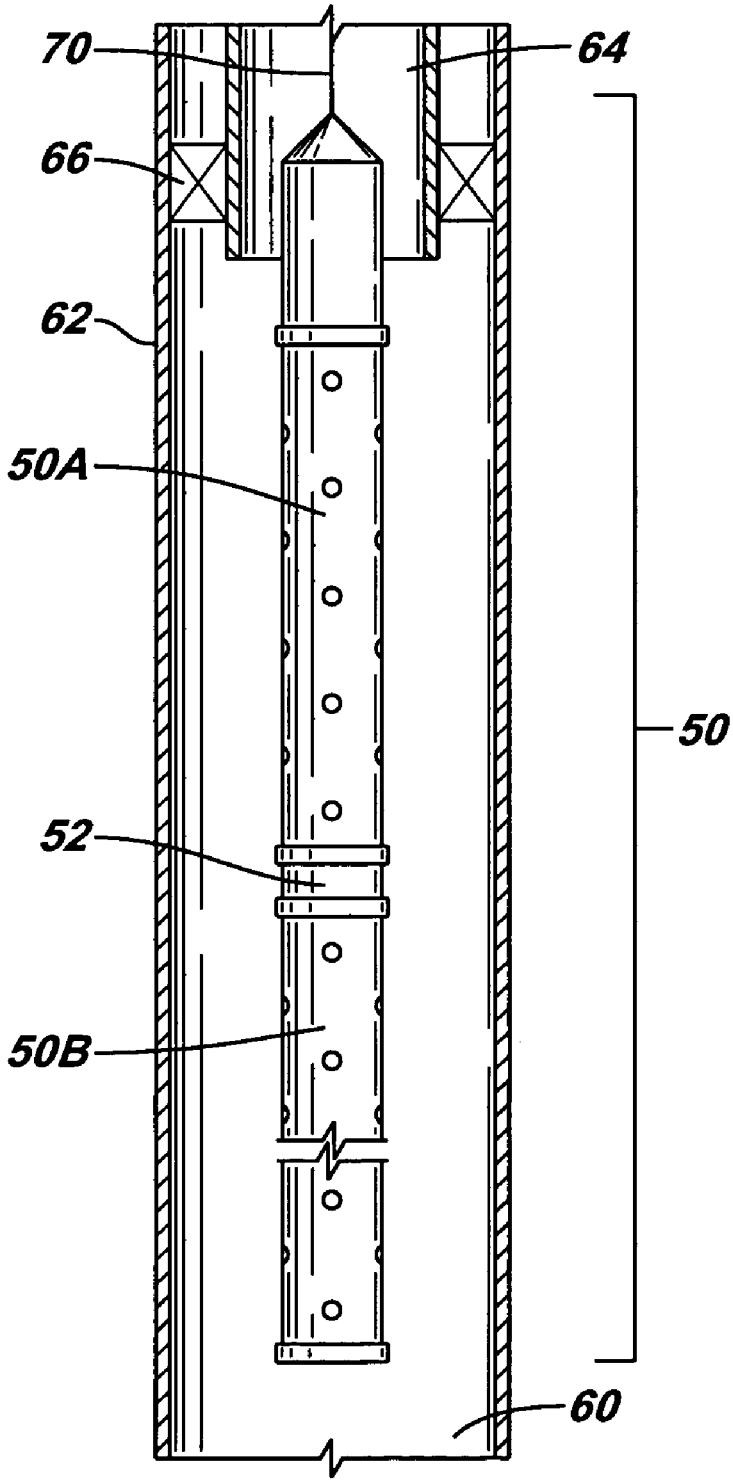
FIG. 3 (Prior Art)
FIG. 3 is an elevation view of a conventional perforating gun string being run downhole in a wellbore.

Referring to FIG. 3, a series of hollow carrier guns 50A and 50B may be assembled to form a perforating gun string 50 having a desired length. An example length of each gun 50A, 50B may be about 20 feet. To make a perforating gun string 50 of a few hundred feet or longer, several guns may be connected together in series by adapters 52. Each of the adapters 52 contains a ballistic transfer component, which may be in the form of donor and receptor booster explosives. Ballistic transfer takes place from one gun to another as the detonation wave jumps from the donor to the receptor booster. At the end of the receptor booster is a detonating cord that carries the wave and sets off the shaped charges in the next gun. Examples of explosives that may be used in the various explosive components (e.g., shaped charges 10, detonating cord 15, and boosters) include RDX, HMX, HNS, TATB, and others.

Generally, once assembled, the gun string 50 is positioned in a wellbore 60 that is lined with casing 62. A tubing or pipe 64 extends inside the casing 62 to provide a conduit for well fluids to wellhead equipment (not shown). A portion of the wellbore 60 is isolated by packers 66 set between the exterior of the tubing 64 and the interior of the casing 62. The perforating gun string 50 may be lowered through the tubing or pipe 64 on a carrier line 70 (e.g., wireline, slickline, or coiled tubing). Once positioned at a desired wellbore interval where the gun string 50 is fired to create perforations in the surrounding casing and formation.

The resulting perforation achieved by detonating these guns may be a function of the physical size and geometrical arrangement of the shaped charges in the loading tube. For example, in the embodiments illustrated in FIGS. 1-3, the loading tube 40 includes shaped charges 10 arranged in a spiral arrangement to perforate in a plurality of directions. In alternative embodiments, other phasing patterns may be used.

In another example, the physical size of the shaped charge may dictate the effectiveness of the perforation. Depending on wellbore conditions encountered and perforation results sought, it may be necessary to vary the size of the shaped charges used to achieve a particular result. For instance, smaller (non-standard) shaped charges may be needed to load into a perforating gun having a standard loading tube with openings sized to receive larger charges. Accordingly, an adapter for holding such shaped charges in a standard or universal loading tube is desirable.

The present invention is directed at an adaptor for fitting relatively small shaped charges into a standard loading tube that is designed to receive larger shaped charges. A standard loading tube may generally be a stock item or one that is commonly kept in inventory for use in typical perforating operations. Such a loading tube is generally equipped with a jacket mechanism for receiving shaped charges of a particular shape and size, and is not compatible with receiving shaped charges of a size outside the design parameter.

Generally, one embodiment of the present invention includes an adaptor for holding a shaped charge, wherein the adaptor is connectable to a standard or universal loading tube, and wherein the shaped charge has a shape and size that otherwise would be incompatible with the standard or universal loading tube. The adaptor includes: (1) a mechanism for holding the shaped charge, and (2) a mechanism for mounting the shaped charge to a loading tube.

Figure 4A:
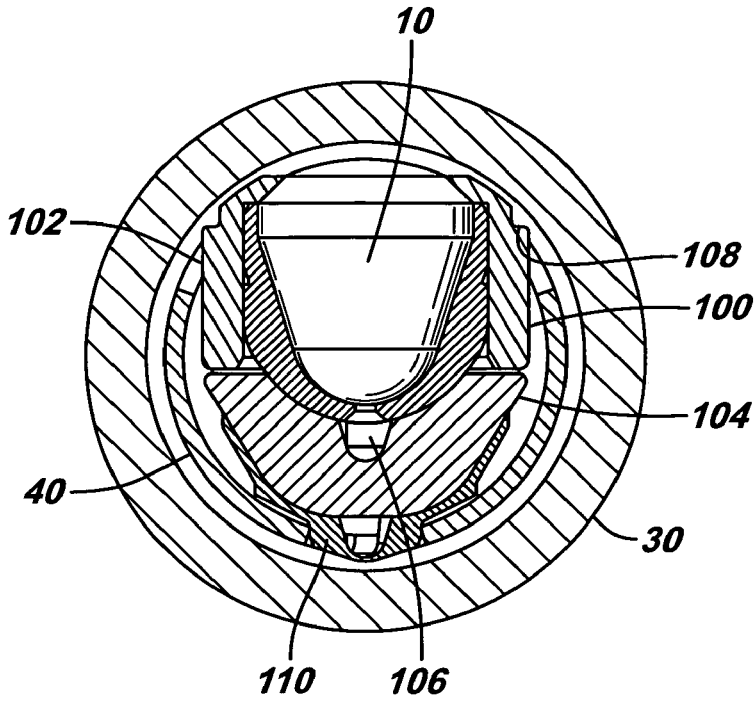
FIG. 4A is an axial view of one embodiment of a perforating gun in accordance with the present invention illustrating a shaped charge housed within a pill-shaped holder and loaded into a receiving jacket, which is mounted to a universal loading tube.
Figure 4B:
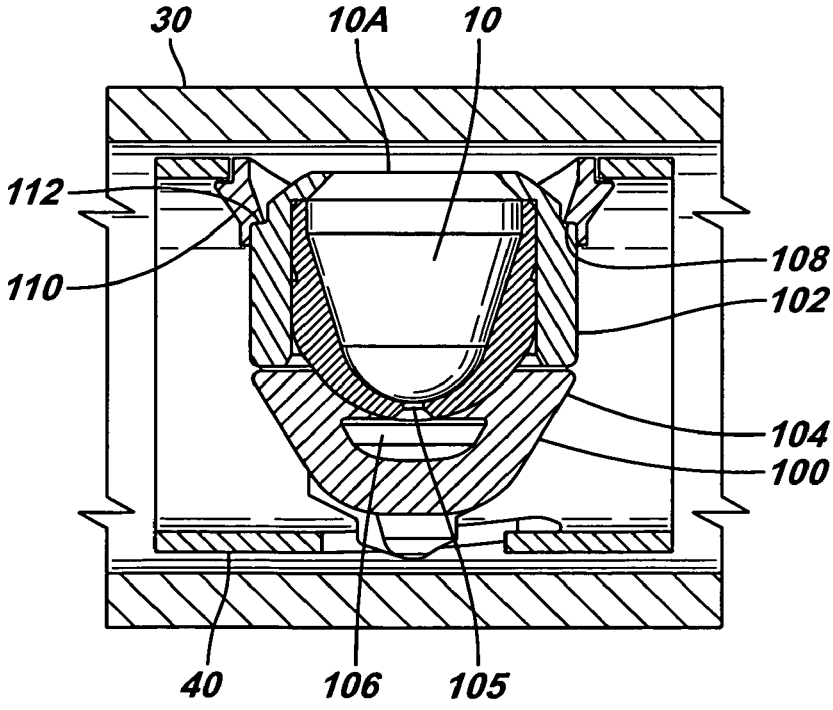
FIG. 4B is an axial view of one embodiment of a perforating gun in accordance with the present invention illustrating a shaped charge housed within a pill-shaped holder and loaded into a receiving jacket, which is mounted to a universal loading tube.

More specifically, with respect to FIGS. 4A and 4B, one embodiment of the shaped charge adaptor of the present invention includes a housing assembly 100 (or "holder") for holding a shaped charge 10. The housing assembly 100 includes a top section 102 and a bottom section 104 which when connected together define an interior bore for receiving the shaped charge 10. The top section 102 and bottom section 104 may connected together by any conventional connecting mechanism including, inter alia, threads, pins, slots, fingers, or other fasteners. The top section 102 has an upper end with an opening to expose the upper surface (or "face") 10A of the shaped charge 10. The bottom section 104 of the housing assembly 100 has a lower end with a small opening 105 and a groove 106 formed therein for receiving a detonating cord (not shown). The detonating cord 15 must be held in contact with the primer column 14 of the shaped charge 10 (as shown in FIG. 1) to facilitate detonation.

In downhole perforation operations, it may be desirable to load a small shaped charge 10 into a hollow carrier gun 30 having a standard loading tube 40. For example, with reference to FIGS. 4A and 4B, a standard 2⅞" perforating gun system includes a hollow carrier 30 having an outer diameter of approximately 2.80" and a standard loading tube having an outer diameter of approximately 1.80", which is positioned in the bore of the carrier. The standard loading tube 40 has openings designed to receive shaped charges of approximately 1.58" in length via a standard jacket 110. However, to load a smaller shaped charge 10 (e.g., a Schlumberger's PURE charge having a length of approximately 1.11") into the standard jacket 110 of the loading tube 40, the shaped charge may be first placed inside a "pill-shaped" holder 100, which is designed to have a length of 1.58". Subsequently, the holder 100 is inserted into the standard jacket 110. To latch the holder 100 to the jacket 110, the holder includes a circumferential groove 108 formed therein for receiving a protruding shoulder 112 formed in the jacket. As shown in FIGS. 4A and 4B, the groove 108 and shoulder 112 are formed on the upper end of the holder 100 and jacket 110 respectively.

Figure 5A:
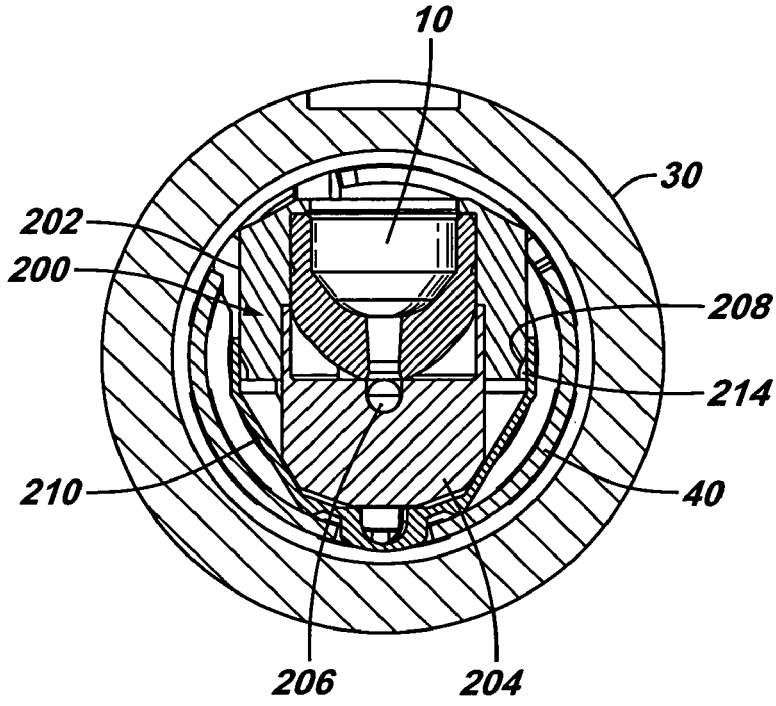
FIG. 5A is an axial view of one embodiment of a perforating gun in accordance with the present invention illustrating a shaped charge housed within a mushroom-shaped holder and loaded into a receiving jacket, which is mounted to a universal loading tube.
Figure 5B:
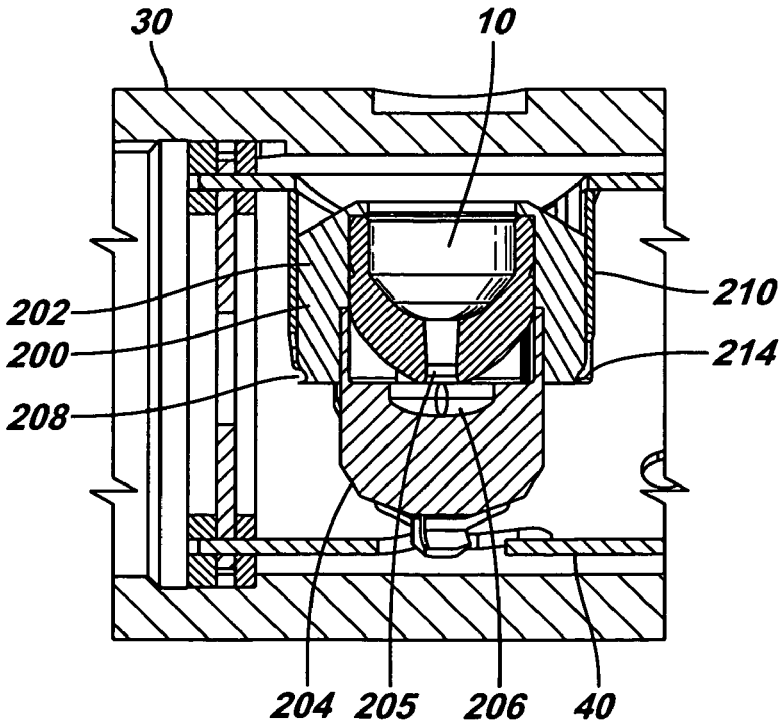
FIG. 5B is an axial view of one embodiment of a perforating gun in accordance with the present invention illustrating a shaped charge housed within a mushroom-shaped holder and loaded into a receiving jacket, which is mounted to a universal loading tube.

In another embodiment, with reference to FIGS. 5A and 5B, a standard 3⅜" perforating gun system includes a hollow carrier 30 having an outer diameter of approximately 3⅜" and a standard loading tube having an outer diameter of approximately 2½", which is positioned in the bore of the carrier. The standard loading tube 40 has openings designed to receive shaped charges of approximately 1.80" in length via a standard jacket 210. However, to load a smaller shaped charge 10 e.g., a Schlumberger's PURE charge having a length of approximately 1.11" into the standard jacket 210 of the loading tube 40, the shaped charge may be first placed inside a "mushroom-shaped" holder 200, which is designed to have a length of 1.80". As with the pill-shaped holder 100 shown in FIGS. 4A and 4B, the mushroom-shaped holder 200 includes a top section 202 and a bottom section 204, which define an interior bore when connected together to receive the shaped charge 10. The bottom section 204 has a lower end with a small opening 205 and a groove 206 formed therein for receiving a detonating cord (not shown). The detonating cord 15 must be held in contact with the primer column 14 of the shaped charge 10 (as shown in FIG. 1) to facilitate detonation. Once housed in the holder 200, the shaped charge 10 is inserted into the standard jacket 210. To latch the holder 200 to the jacket 110, the holder includes a circumferential groove 208 formed therein for receiving a protruding shoulder 214 formed in the jacket. As shown in FIGS. 5A and 5B, the groove 208 and shoulder 214 are formed on the lower end of the holder 200 and jacket 210 respectively.

While the shaped charge holder 100 illustrated in FIGS. 4A and 4B include a "pill-shaped" housing and the holder 200 illustrated in FIGS. 5A and 5B includes a "mushroom-shaped" housing, it in intended that other shapes may be used to correspond with the shape of the jacket and loading tube. Moreover, while a shoulder-and-groove latching mechanism is illustrated for fastening the holder to the jacket, it is intended that any conventional fastening mechanism may be used. Moreover, in other embodiments of the present invention, the fastening mechanism is located at any position between the top and bottom of the holder and jacket.

Moreover, in another embodiment of the adaptor, the housing assembly 100 is formed to be a single, integrated housing unit (i.e., a single-piece housing instead of a two-piece housing). In this embodiment, the opening in the housing is used to receive the shaped charge.

Figure 6A:
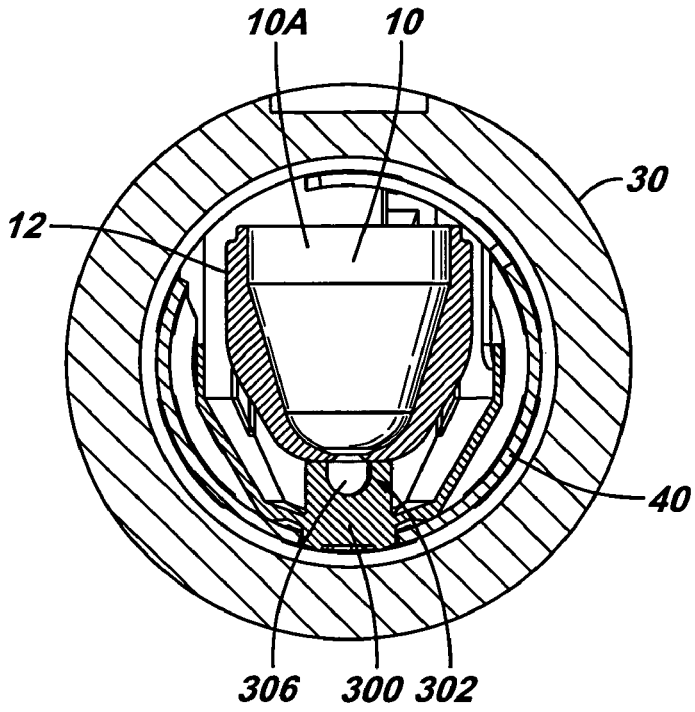
FIG. 6A is an axial view of one embodiment of the present invention illustrating a shaped charge loaded into a modified jacket, which is mounted in a large perforating gun.
Figure 6B:
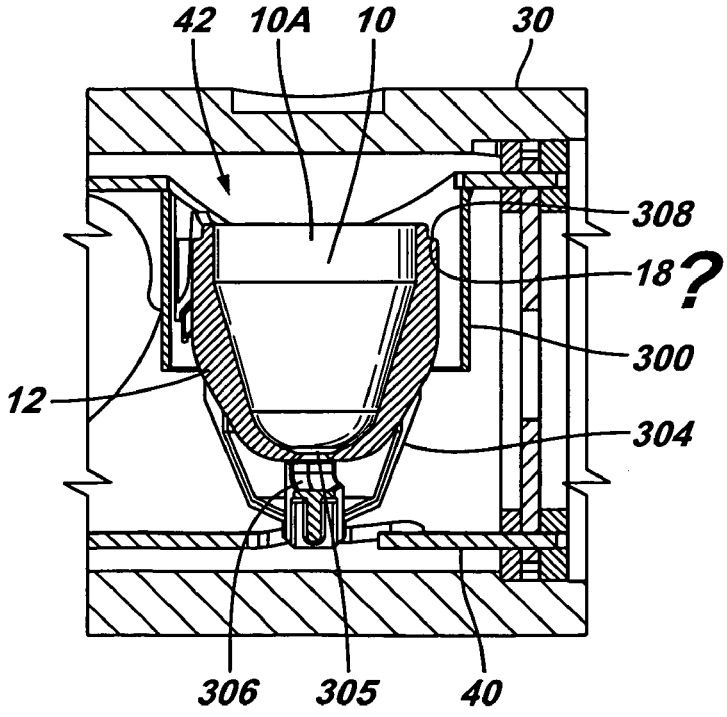
FIG. 6B is an axial view of one embodiment of the present invention illustrating a shaped charge loaded into a modified jacket, which is mounted in a large perforating gun.

With respect to FIGS. 6A and 6B, yet another embodiment of the shaped charge holder of the present invention includes an improved jacket 300 for holding a relatively small shaped charge 10 in a universal loading tube 40 of a hollow carrier perforating gun 30 that is intended to carry larger charges. The improved jacket 300 includes an interior bore with a protruding element 308 formed thereon biased radially inward. The protruding element 308 engages a circumferential groove formed in the casing 12 of the shaped charge 10 to hold the charge to the jacket. The protruding element 308 may be any mechanism for fastening the shaped charge 10 to the jacket 300 including, inter alia, a circumferential ring, or a plurality of latching finger. Moreover, the jacket 300 may be fabricated from polymer-based, metal, or any other durable material capable of enduring wellbore conditions (e.g., high temperature, high pressure, and/or corrosive conditions).

Furthermore, an embodiment of the jacket 300 includes a set of support ribs 302, 304 for supporting a small shaped charge 10 in a position such that the upper surface 10A of the charge is sufficiently close to the carrier 30 and perforating target (e.g., formation production zone) to achieve the desired penetration. The set of ribs includes one or more lower ribs 302 for supporting the bottom of the shaped charge 10 and one or more dorsal ribs 304 for supporting the sides of the shaped charge.

Still furthermore, an embodiment of the jacket 300 includes a small opening 305 and a groove 306 formed in the lower end beneath the axial bore for receiving a detonating cord (not shown). The detonating cord 15 must be held in contact with the primer column 14 of the shaped charge 10 (as shown in FIG. 1) to facilitate detonation.

In downhole perforation operations, it may be desirable to load a small shaped charge 10 into a large hollow carrier gun 30 having a standard loading tube 40. For example, with reference to FIGS. 6A and 6B, a standard 3⅜" perforating gun system includes a hollow carrier 30 having an outer diameter of approximately 2.80" and a standard loading tube having an outer diameter of approximately 1.80", which is positioned in the bore of the carrier. The standard loading tube 40 has openings designed to receive shaped charges of approximately 1.58" in length via a standard jacket 110. However, to load a smaller shaped charge 10 having a length of approximately 1.11" into the loading tube 40, the shaped charge may first be inserted into an improved jacket 300 for supporting smaller charges. While the exterior surface of the jacket 300 is formed to fit an opening 42 in the standard loading tube 40, the interior of the jacket is formed (via ribs 302, 304) to receive a 1.11" long shaped charge 10, instead of the standard 1.58" long charge. Subsequently, the improved jacket 300 is inserted into the opening 42 of the loading tube 40. Once loaded with charges, the loading tube 40 may then be placed in the bore of the hollow carrier 30 and run downhole as part of a gun string to achieve the desired perforation.

While various embodiments of the present invention have been described herein with reference to particular size and measurement data, it is intended that the adaptor of the present invention may be used with components (e.g., shaped charges, jackets, loading tubes, and/or hollow carriers) of any size.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

The invention claimed is:

1. Apparatus for use in perforating a wellbore, the apparatus comprising:

a holder mechanism adapted to receive a first shaped charge, the first shaped charge having a selected size;

a loading tube having a mounting mechanism adapted to connect a second shaped charge having a selected size larger than that of the first shaped charge, the holder mechanism being configured for connection to the mounting mechanism for mounting of the first shaped charge in the loading tube; and wherein the loading tube comprises:

a circular opening having a predetermined diameter, the mounting mechanism comprising:

a jacket having an outer surface formed to engage the circular opening and an inner surface.

2. The apparatus of claim 1, wherein the holder mechanism comprises a housing assembly, having an upper section and a lower section connectable together to define an outer surface an inner bore, the outer bore surface being adapted to engage the inner surface of the jacket and having a selected size approximately the same as the size of the second shaped charge, the inner bore being adapted to receive the first shaped charge.

3. The apparatus of claim 2, wherein the mounting mechanism comprises:

a recess formed in the outer surface of the housing assembly; and a protruding element formed on the inner surface of the jacket, the protruding element being adapted to engage the recess in the housing assembly to lock the housing assembly and the first shaped charge to the jacket of the loading tube.

4. The apparatus of claim 2, wherein the first shaped charge further comprises:

a casing having a proximal end and a distal end;

a primer column arranged on the proximal end of the casing;

an explosive charge arranged between the proximal end and distal end of the casing; and a liner arrange on the distal end of the casing.

5. The apparatus of claim 4, further comprising an opening formed in the upper section of the housing assembly to expose the distal end of the casing of the first shaped charge.

6. The apparatus of claim 4, further comprising an opening formed in the lower section of the housing assembly to receive a detonating cord and to establish communication between the detonating cord and the primer column on the proximal end of the casing of the first shaped charge.

7. The apparatus of claim 1, wherein the first shaped charage further comprises:

a casing having a proximal end and a distal end;

a primer column arranged on the proximal end of the casing;

an explosive charge arranged between the proximal end and distal end of the casing; and a liner arrange on the distal end of the casing.

8. The apparatus of claim 7, wherein the holder mechanism comprises at least one rib formed on the inner surface of the jacket to support the proximal end of the casing.

9. The apparatus of claim 7, wherein the mounting mechanism comprises:

a recess formed in the casing of the first shaped charge; and a protruding element formed on the inner surface of the jacket, the protruding element adapted to engage the recess in the housing assembly to lock the housing assembly and the first shaped charge to the jacket of the loading tube.

10. The apparatus of claim 9, further comprising an opening in the jacket to receive a detonating cord and to establish communication between the detonating cord and the primer column on the proximal end of the casing of the first shaped charge.

11. A method for loading a small shaped charge in a standard loading tube of a perforating gun, comprising:

providing the standard loading tube with a standard jacket mechanism for receiving shaped charged of a particular size larger than the small shaped charge; and inserting the small shaped charge into an adapter, and installing the adapter into the standard jacket mechanism of the loading tube.

12. A charge holder for use in well perforation operations, the charge holder comprising:

a jacket sized for engagement with a loading tube of a standard size;

a housing assembly, having an upper section and a lower section connectable together to define an outer surface and a bore therein, the outer surface being adapted to engage the jacket used in the loading tube, the inner bore being adapted to receive a shaped charge; and a fastening mechanism for connecting the housing assembly to the jacket.

13. The charge holder of claim 12, further comprising:

a groove formed in the lower section of the housing assembly to receive a detonating cord; and an opening formed in the lower section of the housing assembly to establish communication between the shaped charge and the detonating cord.

14. The charge holder of claim 12, wherein the fastening mechanism comprises:

a recess formed in the outer surface of the housing assembly; and a protruding element formed on the jacket, the protruding element being adapted to engage the recess in the housing assembly to lock the housing assembly to the jacket of the loading tube.

15. A shaped charage holder system, comprising:

a jacket sized for engagement with a loading tube of a standard size;

a housing having an outer surface, an inner bore, and an opening therein for communicating with the inner bore, the outer surface adapted to engage the jacket used in the loading tube, the inner bore adapted to receive a shaped charge; and a fastening mechanism for connecting the housing assembly to the jacket.

* * * * *